US007037170B2

(12) United States Patent
Pacella et al.

(10) Patent No.: US 7,037,170 B2
(45) Date of Patent: May 2, 2006

(54) TOY ACCESSORY

(75) Inventors: Jonathan M. Pacella, Coatesville, PA (US); Donald E. Groff, Narvon, PA (US); Curtis M. Hartenstine, Birdsboro, PA (US)

(73) Assignee: Graco Children's Products Inc., Exton, PA (US)

( * ) Notice: Subject to any disclaimer, the term of this patent is extended or adjusted under 35 U.S.C. 154(b) by 0 days.

(21) Appl. No.: 10/609,681

(22) Filed: Jul. 1, 2003

(65) Prior Publication Data

US 2005/0003732 A1 Jan. 6, 2005

(51) Int. Cl.
*A63H 3/00* (2006.01)
*A63H 33/00* (2006.01)

(52) U.S. Cl. ..... 446/268; 446/227

(58) Field of Classification Search ..... 446/268, 446/227; D21/834; 482/35; 5/655
See application file for complete search history.

(56) References Cited

U.S. PATENT DOCUMENTS 1,826,810 A * 10/1931 Buichi ..... 248/102
2,498,203 A * 2/1950 Fischer ..... 5/98.3
3,978,610 A * 9/1976 Stubbmann ..... 446/227
4,043,349 A * 8/1977 Gays et al. ..... 135/137
4,188,745 A * 2/1980 Harvey et al. ..... 446/227
4,556,391 A * 12/1985 Tardivel et al. ..... 446/7
4,627,588 A * 12/1986 Block ..... 248/163.2
4,664,640 A * 5/1987 Shindo et al. ..... 446/227
4,722,713 A * 2/1988 Williams et al. ..... 446/227
4,901,481 A * 2/1990 Seeley, Jr. ..... 52/2.15
4,945,584 A 8/1990 LaMantia
5,076,520 A * 12/1991 Bro ..... 248/165
5,356,132 A * 10/1994 McEwan et al. ..... 473/411
D359,869 S 7/1995 Oren
5,478,268 A * 12/1995 Au ..... 446/227
D374,692 S * 10/1996 Stroud et al. ..... D21/476
5,778,465 A 7/1998 Myers
D408,192 S * 4/1999 Chiang ..... D6/596
5,928,054 A * 7/1999 Mast ..... 446/227
5,930,854 A * 8/1999 O'Neill et al. ..... 5/655
5,987,822 A * 11/1999 McNiff et al. ..... 52/2.11
6,113,455 A * 9/2000 Whelan et al. ..... 446/227
D435,883 S 1/2001 Laosunthara et al.
6,178,978 B1 * 1/2001 Rieber ..... 135/96
6,250,837 B1 6/2001 Mariol et al.

(Continued)

FOREIGN PATENT DOCUMENTS

EP 930035 A1 * 7/1999

(Continued)

OTHER PUBLICATIONS

Photographs of Kolcraft Travelin' Tot 4-in-1 Activity Center, data presently undetermined, 6 pp.

*Primary Examiner*—Boyer D. Ashley
*Assistant Examiner*—Ali Abdelwahed
(74) *Attorney, Agent, or Firm*—Lempia IP Group, LLC

(57) ABSTRACT

A toy accessory includes an arch and a connector attached to each end of the arch. The connector is configured to attach to either of a top rail of a juvenile product and an edge of a play mat. The connector includes an arch connection portion configured to connect to the respective end of the arch and also includes a receiving portion configured to receive either of the top rail of the juvenile product and the edge of the play mat. The connector further may include a play mat connection portion configured to connect to a surface of the play mat.

20 Claims, 7 Drawing Sheets

U.S. PATENT DOCUMENTS

| | | | | |
|---|---|---|---|---|
| 6,385,800 | B1 | 5/2002 | Chen et al. | |
| 6,434,767 | B1 | 8/2002 | Welsh, Jr. | |
| 6,640,985 | B1 * | 11/2003 | Cheng | 211/118 |
| 6,702,643 | B1 * | 3/2004 | Drosendahl et al. | 446/227 |
| 2004/0077269 | A1 * | 4/2004 | Oren et al. | 446/227 |
| 2004/0224823 | A1 * | 11/2004 | Myers et al. | 482/35 |

FOREIGN PATENT DOCUMENTS

| | | | |
|---|---|---|---|
| WO | WO 02/05917 | A1 * | 1/2002 |

* cited by examiner

TOY ACCESSORY

BACKGROUND OF THE INVENTION

The present invention relates generally to a toy accessory. More specifically, the present invention relates to a toy accessory that can be attached to a juvenile product, such as a playard, a bassinet, or a crib, and to a play mat.

Parents of young children often need to place their children in a safe environment, for example, a playard, a bassinet, or a crib, while they attend to household duties. Parents also often place their children on a play mat on the floor where, under the watchful eye of the parent, the child can play on the play mat. Whether in a playard or on a play mat, children enjoy looking at toys suspended above them. In this regard, there is a need for a toy accessory that easily can be transferred from the playard to the play mat, and back again.

SUMMARY OF THE INVENTION

An aspect of the invention relates to a toy accessory comprising an arch and a connector attached to each end of the arch. The connector is configured to attach to either of a top rail of a juvenile product and an edge of a play mat. The connector includes an arch connection portion configured to connect to the respective end of the arch and also includes a receiving portion configured to receive either of the top rail of the juvenile product and the edge of the play mat. The connector further may include a play mat connection portion configured to connect to a surface of the play mat.

Another aspect of the invention relates to a juvenile product assembly comprising a playard including top rails, a play mat sized to be placed in a bottom of the playard, and a toy accessory. The toy accessory comprises an arch, which has a first end and a second end, and a connector attached to each of the first and second ends of the arch. The connector is configured to attach to either of a top rail of the playard and an edge of the play mat.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention.

DETAILED DESCRIPTION OF THE PREFERRED EMBODIMENTS

Reference will now be made in detail to presently preferred embodiments of the invention, examples of which are illustrated in the accompanying drawings. An effort has been made to use the same reference numbers throughout the drawings to refer to the same or like parts.

Figure 1:
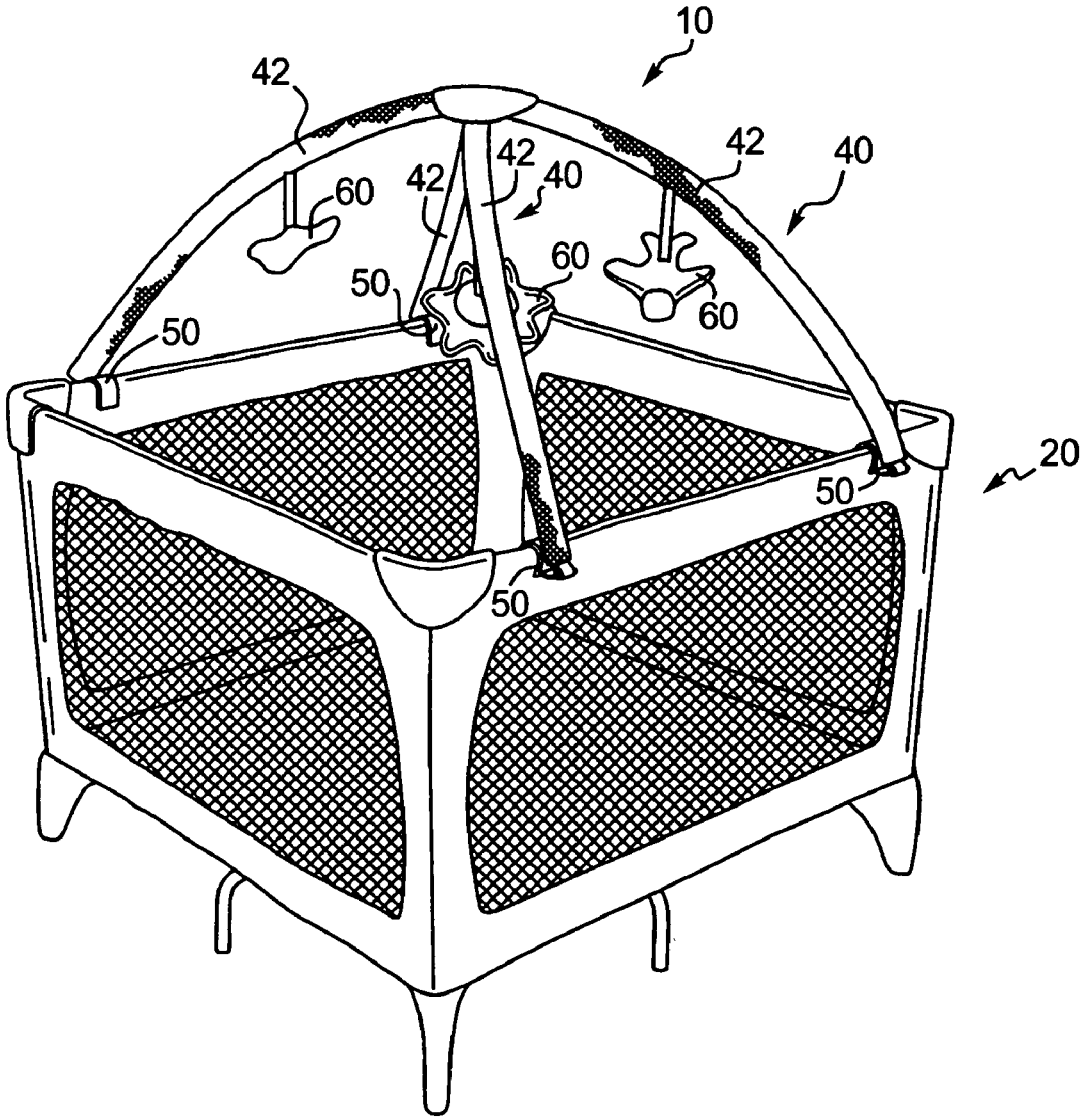
FIG. 1 is a top perspective view of a toy accessory attached to a playard in accordance with the invention.
Figure 2:
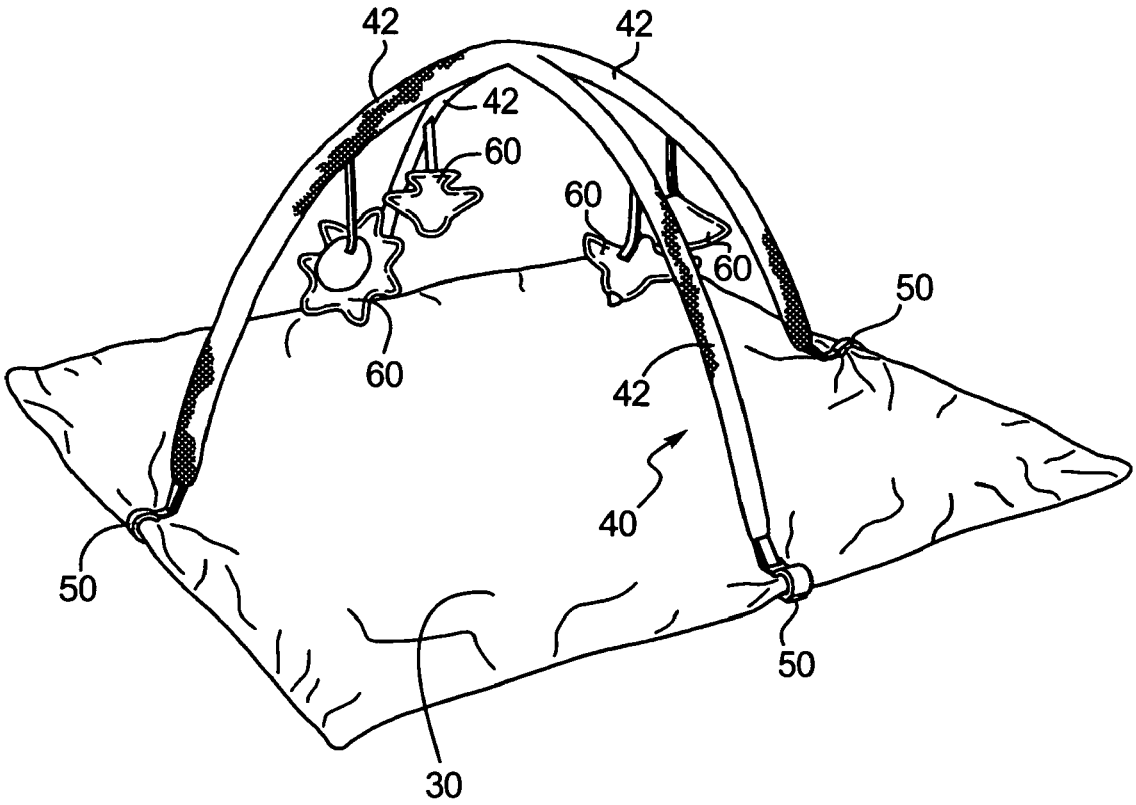
FIG. 2 is a top perspective view of the toy accessory attached to a play mat in accordance with the invention.

Referring now to the drawings, FIGS. 1 and 2 illustrate a toy accessory 10 that is configured to be mountable either to a juvenile product, such as playard 20, as shown in FIG. 1, and to a play mat 30, as shown in FIG. 2. Accordingly, the toy accessory 10 can be used to entertain a child while the child plays in the juvenile product and, in addition, while the child plays on a play mat on the floor. In this manner, the toy accessory 10 is versatile and can be used in several different contexts. For example, some playards come with a mattress pad sized to fit in the bottom on the playard. The mattress pad, when removed from the playard and placed on the floor, can serve as a play mat. In this regard, the mattress pad can be positioned in the bottom of the playard, in a bassinet frame suspended from the top rails of the playard, or on the floor outside the playard, depending on whether the caregiver wishes to place the child in the playard, in the bassinet, or on the floor, respectively. The toy accessory 10, in turn, can be mounted to the top rails of the playard to overhang the bottom of the playard, to the top rails of the playard to overhang the bassinet, or to the edges of the mattress pad to overhang the mattress pad. Accordingly, in all three contexts, the child can enjoy the entertainment value of the toy accessory 10.

The toy accessory 10 includes at least one arch 40, and preferably two arches, that can extend over the playard 20, as shown in FIG. 1, or over the play mat 30, as shown in FIG. 2. A connector 50 is attached to each end of the arch 40. Each connector 50 is configured to attach either to the top rail of the playard 20 or to the edge of the play mat 30. Toys 60 can be suspended from the arches 40 to provide visual stimulation to a child playing in the playard 20 or playing on the play mat 30. The toys 60 can be suspended from the arches 40 by short lengths of mesh with patches of hook and loop type fastening material to which the toys 60 can be removably attached, or by any other suitable suspension arrangement.

Figure 5:
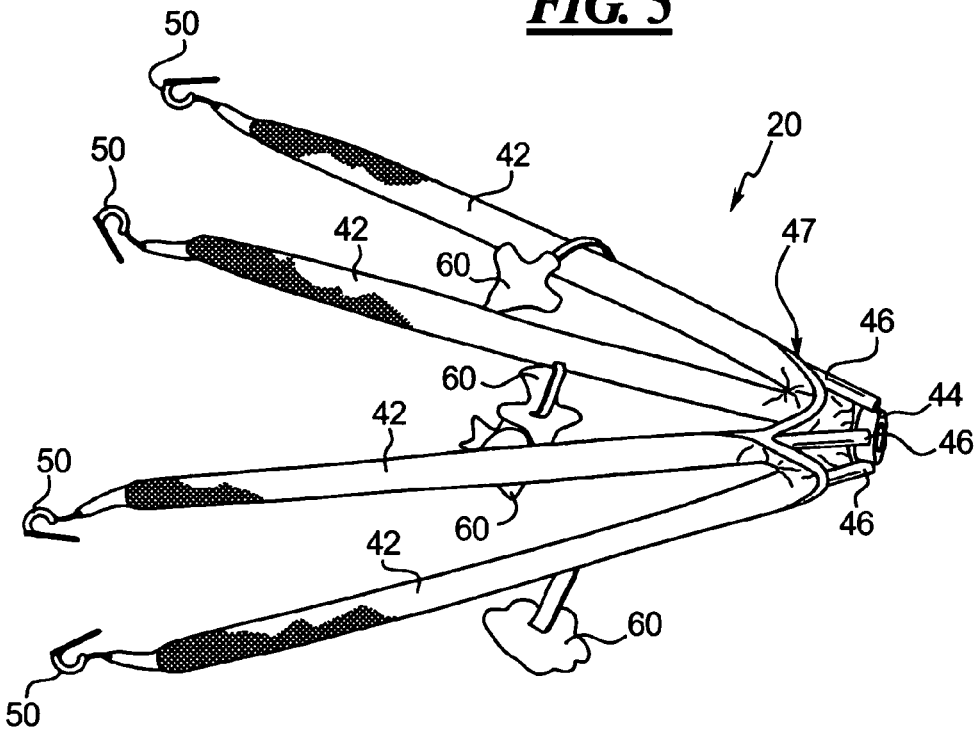
FIG. 5 is a perspective view of the toy accessory in a folded position, illustrating the frame inserted into a frame covering.

The arches 40 each include a pair of legs 42 with first ends that converge at a hub 44, as shown in FIG. 5. The legs 42 each include a resilient leg member 46 and a fabric covering, generally indicated 47, that receives the resilient leg member 46. The connectors 50 can connect to the fabric covering at second ends of the legs 42, opposite the hub 44.

Figure 3:
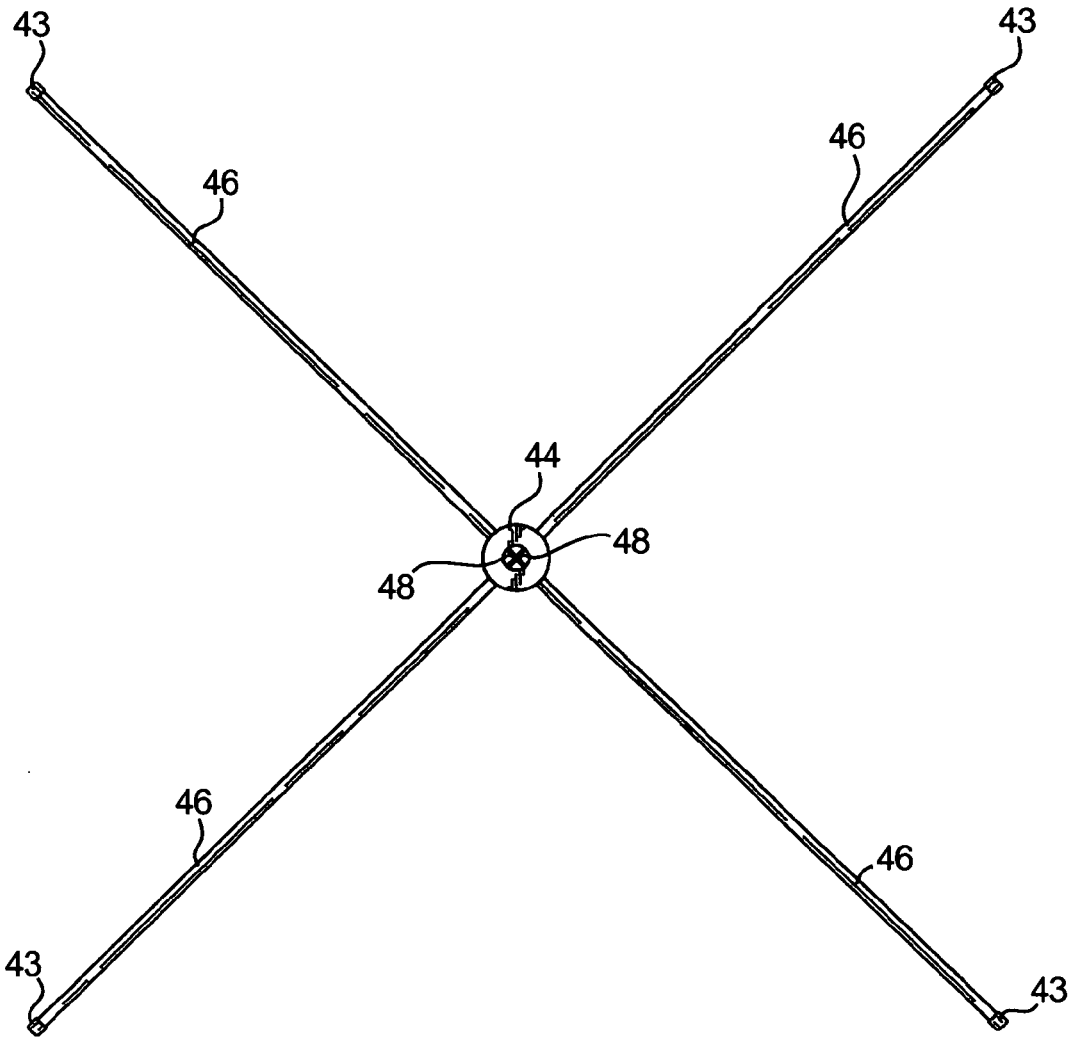
FIG. 3 is a top plan view of the frame of the toy accessory.
Figure 4:
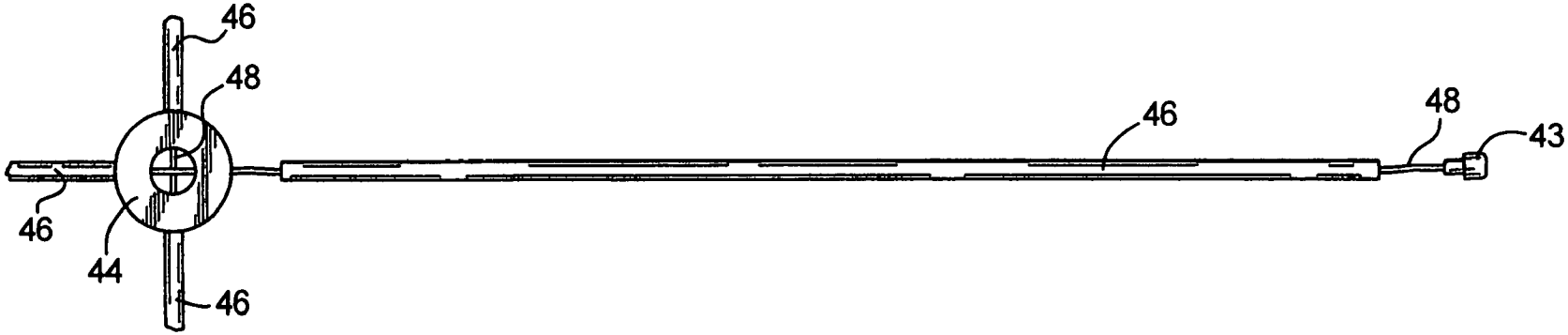
FIG. 4 is a top plan view of a hub, a leg, a cord, and an end cap of the frame of the toy accessory.

The resilient leg members 46 can be hollow, and a cord 48 can extend through each resilient leg member 46 to secure the resilient leg member 46 to the hub 44, as shown in FIGS. 3 and 4. In this regard, a single cord 48 can pass through opposite resilient leg members 46 and through the hub 44, and the ends of the cord 48 can be secured to end caps 43 that fasten to the second ends of the resilient leg members 46. In an alternative embodiment, each resilient leg member 46 can include its own cord 48, which extends between the respective end cap 43 and the hub 44. The cord 46 can be elastic, for example, a bungee type shock cord.

The resilient leg members 46, the hub 44, and the cords 48 form a frame of the toy accessory 10, over which the fabric covering 47 can be placed. In this regard, the leg members 46 can be slid into pockets in the fabric covering 47, as shown in FIG. 5. Further, although the hub 44 of the embodiment of FIG. 5 remains visible even after the fabric covering is inserted over the legs 42, the fabric covering can be modified to include a fabric flap (not shown) for covering the hub 44. That is, a fabric flap can be sewn to a pair of the legs 42, adjacent the hub 44, and this flap then can be secured to the opposite legs 42 by fasteners to cover the hub 44. The flap can cover the hub 44 while the toy accessory 10 is in use, and the flap can be opened during non-use to allow removal of the frame for machine-washing of the fabric covering.

The leg members 46 are made of a flexible, resilient material so that the toy accessory 20 can be collapsed to the folded position seen in FIG. 5 and then quickly re-assume its in-use position when mounted to a playard 20 or play mat 30, as seen in FIGS. 1 and 2, respectively. Suitable resilient materials to form leg members 46 include polycarbonate tubing, fiberglass or graphite rods, or nylon or acetal tubing.

Figure 6:
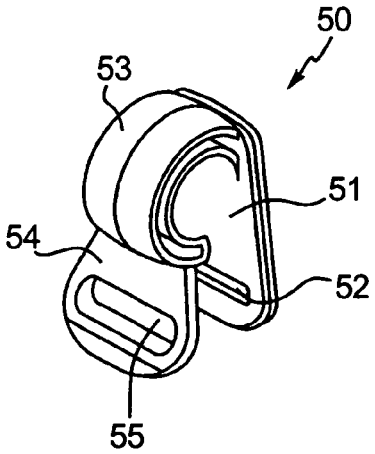
FIG. 6 is a perspective view of the connector.
Figure 7:
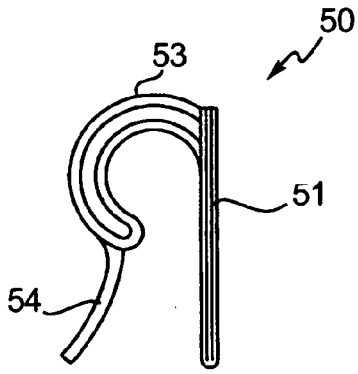
FIG. 7 is a side elevation view of the connector.

FIGS. 6 and 7 show a connector 50 suitable for the toy accessory 20. The connector 50 can be a plastic injection-molded structure. The connector 50 includes an arch connection portion configured to connect to the second end of each leg 42 of the arches 40. The arch connection portion of the connector 50 is movable relative to the second end of the respective leg 42 about more than a single axis. The connector 50 also includes a receiving portion configured to receive either of the top rail of the playard 20 and the edge of the play mat 30. The connector 50 further can include a play mat connection portion configured to connect to a surface of the play mat 30 to facilitate mounting the toy accessory 10 to the play mat 30. The play mat connection portion can comprise a base 51 having a first aperture 52, and the receiving portion can comprise a curved portion 53 connected to the base 51. The first aperture 52 can be disposed adjacent a first end of the base 51, and the curved portion 53 can be connected to a second end of the base 51. The arch connection portion can comprise an extension 54 connected to the curved portion 53. In this regard, the first end of the curved portion 53 can be connected to the second end of the base 51, and the second end of the curved portion 53 can be connected to the extension 54. The extension 54 can have a second aperture 55 to receive a portion of the fabric covering of a leg 42 to connect the connector 50 to the leg 42. The extension 54 of the arch connection portion is movable relative to fabric covering of the leg 42 about more than a single axis, as can be understood from FIG. 10, for example. In addition, the extension 54 can curve away from the base 51 so that it is relatively easy to guide a top rail 21 of the playard 20 or an edge of the play mat 30, as appropriate, between the extension 54 and the base 51, toward the curved portion 53.

Figure 9:
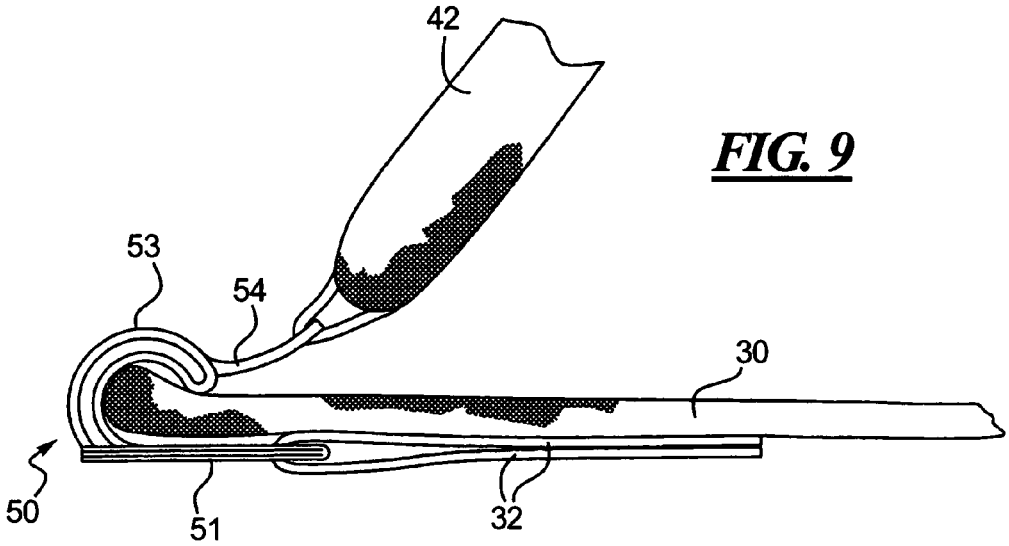
FIG. 9 is an enlarged, side elevation view of the connector of the toy accessory attached to the play mat.
Figure 10:
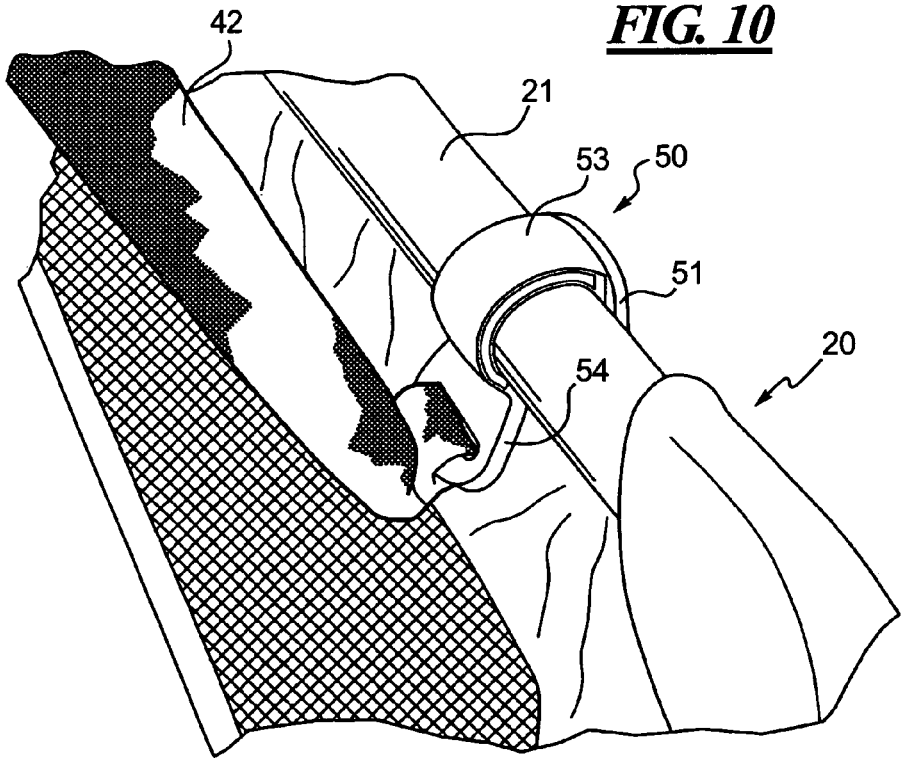
FIG. 10 is an enlarged, top perspective view of the connector of the toy accessory attached to a top rail of the playard.

FIGS. 9 and 10 show detail views of the connector 50 connected to the play mat 30 and the playard 20, respectively. The curved portion 53 of the connector 50 is sized to receive either of the top rail 21 of the playard 20, as seen in FIG. 10, and the edge of the play mat 30, as seen in FIG. 9. The curved portion 53 can have a concave surface that faces the base 51 to fit relatively snugly against the top rail 21 of the playard 20 and the edge of the play mat 30.

The connector 50 can be connected to any portion of the top rails 21 of the playard 20. In this regard, FIG. 1 shows two connectors 50 attached to a first top rail of the playard 20 and two connectors 50 attached to a second, opposite top rail of the playard 20. Because the arches 40 can move and flex about the hub 44, one of the legs 42 attached to the first top rail could be moved to a third top rail, and one of the legs 42 attached to the second top rail could be moved to a fourth top rail; in this arrangement, the top accessory 10 would be mounted to the playard 10 by one connector per top rail. In addition, the playard 20 may include visual indicators printed on the fabric surrounding the top rails 21 to indicate optimal locations for attachment of the connectors 50.

Figure 8:
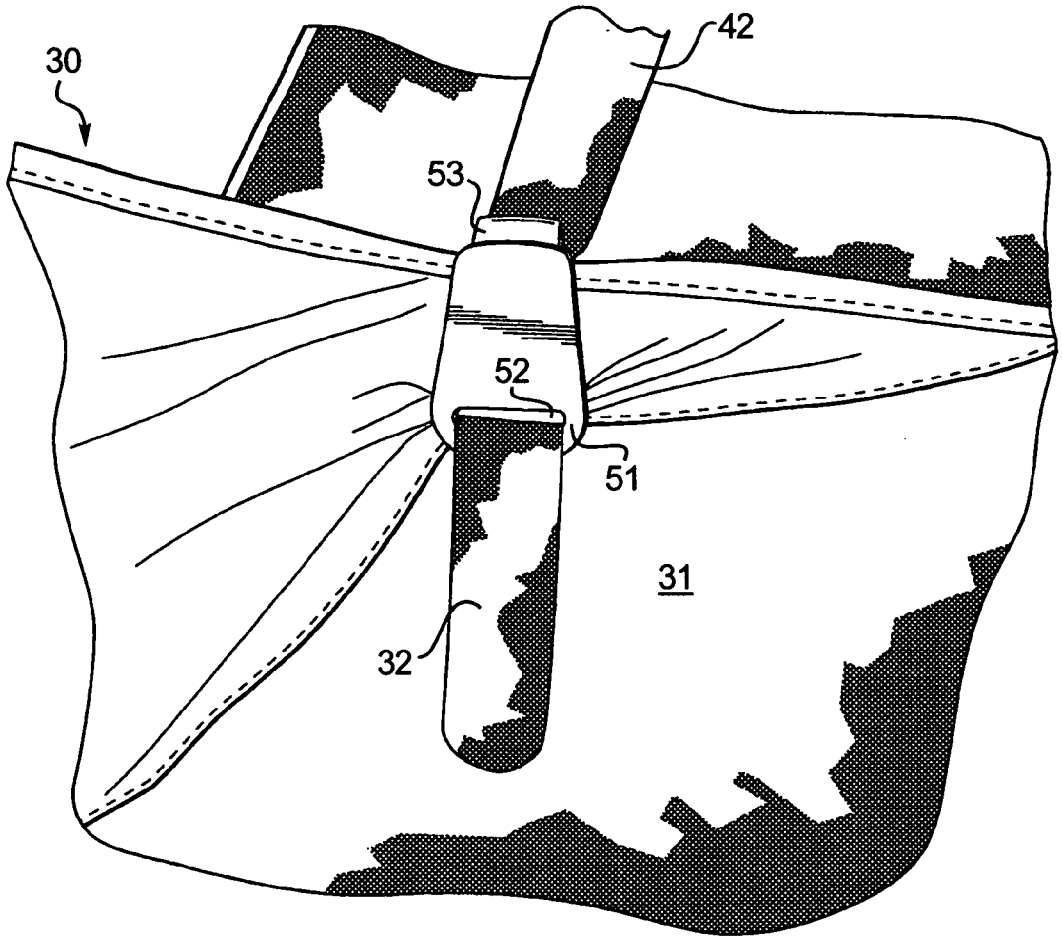
FIG. 8 is an enlarged, bottom perspective view of a portion of the play mat, illustrating the connector attached to a surface of the play mat.

FIG. 8 shows the connector 50 secured to a bottom surface 31 of the play mat 30. As mentioned above, the base 51 of the connector 50 has a first aperture 52. The play mat 30 can include a strap 32 on its bottom surface 31 for threading through the first aperture 52 to assist in securing the connector 50 to the edge of the play mat 30. The strap 32 can include hook and loop type fastening material so that the strap 32 can be secured to itself after being threaded through the first aperture 52, as shown in FIG. 9.

While the drawings illustrate the toy accessory 10 mounted to a playard 20, it will be understood that the toy accessory 10 can be mounted to other juvenile products having top rails, such as bassinets and cribs. In addition, although the drawings illustrate a toy accessory 10 having two arches 40, it will be understood that other embodiments of the toy accessory 10 can include three or more arches 40.

The toy accessory 10 of the present invention does not require that the playard or the play mat be equipped with special attachment features for engagement with the connectors 50 of the toy accessory 10. Rather, the connectors 50 of the toy accessory 10 are constructed so that the toy accessory 10 can be connected to conventional playards having top rails and to the edges of conventional play mats, including mattress pads of conventional playards.

Further, because the toy accessory 10 can be connected to both the play mat 30 and the playard 20, the toy accessory 10 has broader application than those exclusively used as accessories for play mats.

The preferred embodiments have been set forth herein for the purpose of illustration. This description, however, should not be deemed to be a limitation on the scope of the invention. Various modifications, adaptations, and alternatives may occur to one skilled in the art without departing from the claimed inventive concept. The true scope and spirit of the invention are indicated by the following claims.

What is claimed is:

1. A toy accessory comprising:

an arch; and a connector attached to each end of the arch, the connector configured to attach to either of a top rail of a juvenile product and an edge of a play mat, the connector including an arch connection portion configured to connect to the respective end of the arch and including a receiving portion configured to receive either of the top rail of the juvenile product and the edge of the play mat, wherein the arch connection portion of the connector is movable relative to the respective end of the arch about more than a single axis, and the receiving portion of the connector is positionable in a first orientation relative to the arch for receipt of the top rail of the juvenile product and is positionable in a second orientation relative to the arch for receipt of the edge of the play mat.

2. The toy accessory according to claim 1, wherein the arch includes a pair of legs and a hub, the legs each having a first end and a second end, the first ends of the legs converging at the hub, and the second ends of the legs connecting to respective connectors.

3. The toy accessory according to claim 2, wherein the legs each include a resilient leg member and a covering that receives the resilient leg member.

4. The toy accessory according to claim 3, wherein the arch connection portion of the respective connectors connects to the covering at the second ends of the respective legs.

5. The toy accessory according to claim 3, wherein the resilient leg member is hollow, and a cord extends through the resilient leg member and attaches the resilient leg member to the hub.

6. The toy accessory according to claim 2, further comprising a second arch having a second pair of legs, each of the second pair of legs having a first end and a second end, the first ends of the second pair of legs converging at the hub and the second ends of the second pair of legs connecting to respective connectors.

7. The toy accessory according to claim 1, wherein the receiving portion comprises a curved portion, and the arch connection portion comprises an extension connected to the curved portion, the extension having an aperture therethrough to connect to the respective end of the arch.

8. The toy accessory according to claim 7, wherein the curved portion is sized to receive either of the top rail of the juvenile product and the edge of the play mat.

9. The toy accessory according to claim 1, wherein the connector further comprises a play mat connection portion configured to connect to a surface of the play mat.

10. The toy accessory according to claim 9, wherein the play mat connection portion comprises a base having a first aperture therethrough, the receiving portion comprises a curved portion connected to the base, and the arch connection portion comprises an extension connected to the curved portion, the extension having a second aperture therethrough.

11. The toy accessory according to claim 10, wherein the arch includes a pair of legs, the legs each include a resilient leg member and a covering that receives the resilient leg member, and a portion of the covering extends through the second aperture to connect the arch to the connector.

12. The toy accessory according to claim 10, wherein the first aperture is disposed adjacent a first end of the base, and the curved portion is connected to a second end of the base.

13. The toy accessory according to claim 12, wherein the curved portion has a first end that is connected to the second end of the base and a second end that is connected to the extension.

14. The toy accessory according to claim 13, wherein the curved portion has a concave surface that faces the base.

15. The toy accessory according to claim 14, wherein the extension curves away from the base.

16. The toy accessory according to claim 10, wherein the curved portion is sized to receive either the top rail of the juvenile product or the edge of the play mat.

17. A juvenile product assembly comprising:

a playard including top rails;

a play mat sized to be placed in a bottom of the playard; and a toy accessory comprising:

an arch having a first end and a second end; and first and second connectors attached to the first and second ends of the arch, respectively, the first and second connectors each configured to attach to either of a top rail of the playard and an edge of the play mat, the first and second connectors each including an arch connection portion configured to connect to the respective end of the arch and including a receiving portion configured to receive either of the top rail of the playard and the edge of the play mat, wherein the arch connection portion of each of the first and second connectors is movable relative to the respective end of the arch about more than a single axis, and the receiving portion of each of the first and second connectors is positionable in a first orientation relative to the arch for attachment to the top rail of the juvenile product and is positionable in a second orientation relative to the arch for attachment to the edge of the play mat.

18. The juvenile product assembly according to claim 17, wherein the arch includes a pair of legs and a hub, the legs each having a first end and a second end, the first ends of the legs converging at the hub, and the second ends of the legs connecting to respective connectors.

19. The juvenile product assembly according to claim 18, wherein the receiving portion comprises a curved portion sized to receive either of the top rail of the playard and the edge of the play mat, and the arch connection portion comprises an extension connected to the curved portion, the extension having an aperture therethrough to connect to the second end of the respective leg.

20. The juvenile product assembly according to claim 17, wherein the first and second connectors each further include a play mat connection portion configured to connect to a surface of the play mat.

* * * * *